US007195080B2

(12) United States Patent
De Luca

(10) Patent No.: US 7,195,080 B2
(45) Date of Patent: Mar. 27, 2007

(54) EXPANDABLE DRILLING TOOL AND METHOD

(76) Inventor: Italo De Luca, Dallaan 42, B-1933, Sterrebeek (BE)

( * ) Notice: Subject to any disclaimer, the term of this patent is extended or adjusted under 35 U.S.C. 154(b) by 114 days.

(21) Appl. No.: 10/479,475

(22) PCT Filed: Jun. 1, 2001

(86) PCT No.: PCT/BE01/00096

§ 371 (c)(1),
(2), (4) Date: Jun. 2, 2004

(87) PCT Pub. No.: WO02/097231

PCT Pub. Date: Dec. 5, 2002

(65) Prior Publication Data

US 2004/0206547 A1 Oct. 21, 2004

(51) Int. Cl.
*E21B 7/28* (2006.01)
*E21B 10/32* (2006.01)

(52) U.S. Cl. ..... 175/57; 175/266; 175/271; 175/269; 175/291; 175/406

(58) Field of Classification Search ..... 175/57, 175/271, 267, 269, 291, 406, 266
See application file for complete search history.

(56) References Cited

U.S. PATENT DOCUMENTS

| | | | | |
|---|---|---|---|---|
| 2,719,700 | A | 10/1955 | Kammerer | |
| 3,171,503 | A | 3/1965 | Shirley | |
| 4,589,504 | A | 5/1986 | Simpson | |
| 5,253,714 | A | 10/1993 | Davis et al. | |
| 5,385,205 | A | 1/1995 | Hailey | |
| 2004/0084183 | A1 * | 5/2004 | Zupanick | 166/286 |

FOREIGN PATENT DOCUMENTS

| | | |
|---|---|---|
| WO | WO 01/29364 A1 | 4/2001 |

* cited by examiner

*Primary Examiner*—Jennifer H. Gay
*Assistant Examiner*—Robert Fuller
(74) *Attorney, Agent, or Firm*—Hovey Williams LLP

(57) ABSTRACT

A system is provided (1) for increasing the diameter of at least a portion of a well bore, the system being intended to be attached to a drill pipe (3), the system having a support element (10) bearing cutting arms (13, 14) which is movably mounted with respect to a body (4) and wherein the arms and the chamber (6) of the body (4) are designed so as to cooperated. A method is also provided for increasing the diameter of at least a portion of a well bore by drilling.

36 Claims, 12 Drawing Sheets

EXPANDABLE DRILLING TOOL AND METHOD

BACKGROUND OF THE INVENTION

1. Field of the Invention

The present invention relates to a drilling tool suitable for increasing the diameter of a well bore.

2. Description of the State of the Art

Various system have been proposed for increasing or enlarging the diameter of a well bore.

For example, U.S. Pat. No. 4,589,504 discloses a well bore enlarger comprising a tubular cylindrical housing provided with three cutting arms, said cutting arms pivoting with respect to the housing between a first position in which the arms are within the tubular housing and a second position in which the arms extends partly outside the tubular housing. The enlarger disclosed in said document is only suitable for one specific enlargement of the well bore and is not provided with a blocking means. When using an enlarger of the type disclosed in said document, it appears that due to vibration, the cutting elements are quickly damaged.

The system for increasing the diameter of a well bore of the invention is a system having a high stability and even allowing to adapt continuously or substantially continuously the diameter of the well bore, without need to replace the enlarging tool.

SUMMARY OF THE INVENTION

The invention relates to a system for increasing the diameter of at least a portion of a well bore, said system being intended to be attached to a drill pipe driven into rotation by a motor, said system comprising:

a longitudinal substantially cylindrical body extending in a longitudinal direction, said body being provided with means for attaching said body to the drill pipe and having at least one chamber and two openings;

a support element mounted movable with respect to the body in the longitudinal direction of the body, said element being located in the chamber of the body;

two arms provided with cutting means, a first arm being pivotably mounted on the support element around an axis of rotation perpendicular to the longitudinal direction of the body, while the second arm is pivotably mounted on the support around an axis of rotation parallel to the axis of rotation of the first arm, each arm pivoting with respect to the support element between a first position in which the arm extends in the chamber and a second position in which at least a portion of the cutting means extends outside the chamber after passing through an opening of the body;

a blocking means provided with at least a first abutment portion and a second abutment portion, said means being mounted movable with respect to the body in the longitudinal direction of the body;

in which each arm when located in the chamber has at least one first face directed towards the longitudinal axis of the body and at least one second face directed opposite to the longitudinal axis of the body, in which the chamber of the body has a first face inclined with respect to the longitudinal direction of the body, said face acting as abutment for the second face of the first arm when extending in its second position, and a second face inclined with respect to the longitudinal direction of the body, said face acting as abutment for the second face of the second arm when extending in its second position, and in which the first abutment portion has an abutment face parallel to the first face of the first arm when extending in its second position, while the second abutment portion has an abutment face parallel to the first face of the second arm when extending in its second position.

Due to the longitudinal displacement of the support element with respect to the body, as well as due to the longitudinal displacement of the blocking means, the cutting arms are better maintained in position. The cutting arms are substantially clamped.

Advantageously, the body is provided with a first means pivotably mounted with respect to the body around an axis parallel to the axis of pivotment of the first arm, said first means having a flat surface adapted to contact a flat portion of the second face of the first arm at least when the first arm extends partly outside of the opening between its first position and its second position, and a second means pivotably mounted with respect to the body around an axis parallel to the axis of pivotment of the second arm, said second means having a flat surface adapted to contact a flat portion of the second face of the second arm at least when the second arm extends partly outside of the opening between its first position and its second position.

According to an advantageous embodiment, the blocking means is provided with a first means pivotably mounted with respect to the blocking means around an axis parallel to the pivoting axis of the first arm, said first means having a flat surface adapted to contact a flat portion of the first face of the first arm at least when the first arm is blocked partly outside of the opening between its first position and its second position, and a second means pivotably mounted with respect to the blocking means around an axis parallel to the axis of the second arm, said second means having a flat surface adapted to contact a flat portion of the first face of the second arm at least when the second arm is blocked partly outside of the opening between its first position and its second position.

This ensures a still better stability or maintain in position of the cutting arms during their working.

According to a detail of an embodiment, the second face of the first arm comprises a flat portion which is parallel to and contacts a third inclined face of the chamber when the first arm extends in its first position, while the second face of the second arm comprises a flat portion which is parallel to and contacts a fourth inclined face of the chamber when the second arm extends in its first position. This is advantageous for ensuring that the cutting arms are well maintained in position when extending in the first position.

According to a characteristic of an embodiment of the invention, the chamber of the body has a first face inclined with respect to the longitudinal direction of the body, said face acting as abutment for the second face of the first arm when extending in its second position, and a second face inclined with respect to the longitudinal direction of the body, said face acting as abutment for the second face of the second arm when extending in its second position. The body is provided with a first means pivotably mounted with respect to the body around an axis parallel to the axis of pivotment of the first arm, said first means having a flat surface adapted to contact a flat portion of the second face of the first arm at least when the first arm extends partly outside of the opening between its first position and its second position, said flat surface forming an extension of the first face when the second face of the first arm abuts the first inclined face of the body, and a second means pivotably mounted with respect to the body around an axis parallel to the axis of pivotment of the second arm, said second means having a flat surface adapted to contact a flat portion of the second face of the second arm at least when the second arm extends partly outside of the opening between its first position and its second position, said flat surface forming an extension of the second inclined face of the body when the second face of the first arm abuts the second inclined face of the body.

Preferably, in said embodiment, the first means pivotally mounted on the body is located between the first inclined face of the body and the third inclined face of the body, while the second means pivotally mounted on the body is located between the second inclined face of the body and the fourth inclined face of the body.

Most preferably, the first means pivotally mounted on the body is located between the first inclined face of the body and the third inclined face of the body, while the second means pivotally mounted on the body is located between the second inclined face of the body and the fourth inclined face of the body, the inclination of the first and second inclined faces with respect to the longitudinal axis of the body being comprised between 60° and 90°, while the inclination of the third and fourth inclined faces with respect to the longitudinal axis of the body is comprised between 15 and 50°.

According to a detail of an embodiment, the first arm has a protuberance with a lateral end face corresponding to a portion of the lateral face of a cylinder centered with respect to the axis of pivotment of the arm with respect to the support element, while the second arm has a protuberance with a lateral end face corresponding to a portion of the lateral face of a cylinder centered with respect to the axis of pivotment of the second arm with respect to the support element, the support element having a first recess in which the first protuberance extends and a second recess in which the second protuberance extends, said first recess having a face contacting at least partly the lateral end face of the protuberance of the first arm, while said second recess has a face contacting at least partly the lateral end face of the protuberance of the second arm.

According to a further detail of an embodiment of the system of the invention, the support element is provided with a central longitudinal passage in which a rod extends, said rod bearing the blocking means.

Still according to a detail of a possible embodiment, the system further comprises:

a means for controlling the relative longitudinal movement of the support element with respect to the body and the relative longitudinal movement of the blocking means with respect to the body, and/or a stabilizing means.

The means for controlling the movement of the support element can be operated electrically, pneumatically, hydraulically, mechanically, etc. or with a system combining a combination thereof. For example, the control means comprises an indexer, which is for example actuated hydraulically, said indexer having advantageously several distinct positions, such as working position (cutting arms in position for a cutting operation), close position (cutting means extending in the chamber of the body), measuring position (position in which the maximum diameter formed by the arms is defined), adapting position (position in which the position of the arms is adapted).

Said indexer is for example connected to a cylinder or jack actuating the movement of support element.

This controlling means are given as example. It is obvious that the movement of the support element can be operated by other means, such as electrical means, for example by means of a motor driving into rotation an endless screw acting on a part of the support element.

The invention relates also to a drill pipe provided with a system according to the invention.

The invention further relates to a drilling process for increasing the diameter of at least a portion of a well bore, in which the drilling of the portion of the well bore which has to be increased is carried out by means of a drill provided with a system of the invention.

Characteristics and details of the system of the invention will appear from the following detailed description, in which reference is made to the attached drawings.

BRIEF DESCRIPTION OF DRAWINGS

In said drawings:

FIG. 10 is a cross section view along the lines X—X of the pivoting means of

FIG. 9;

FIG. 23 is a schematic view of a control means with an indexer;

DESCRIPTION OF THE PREFERRED EMBODIMENT

Figure 1:
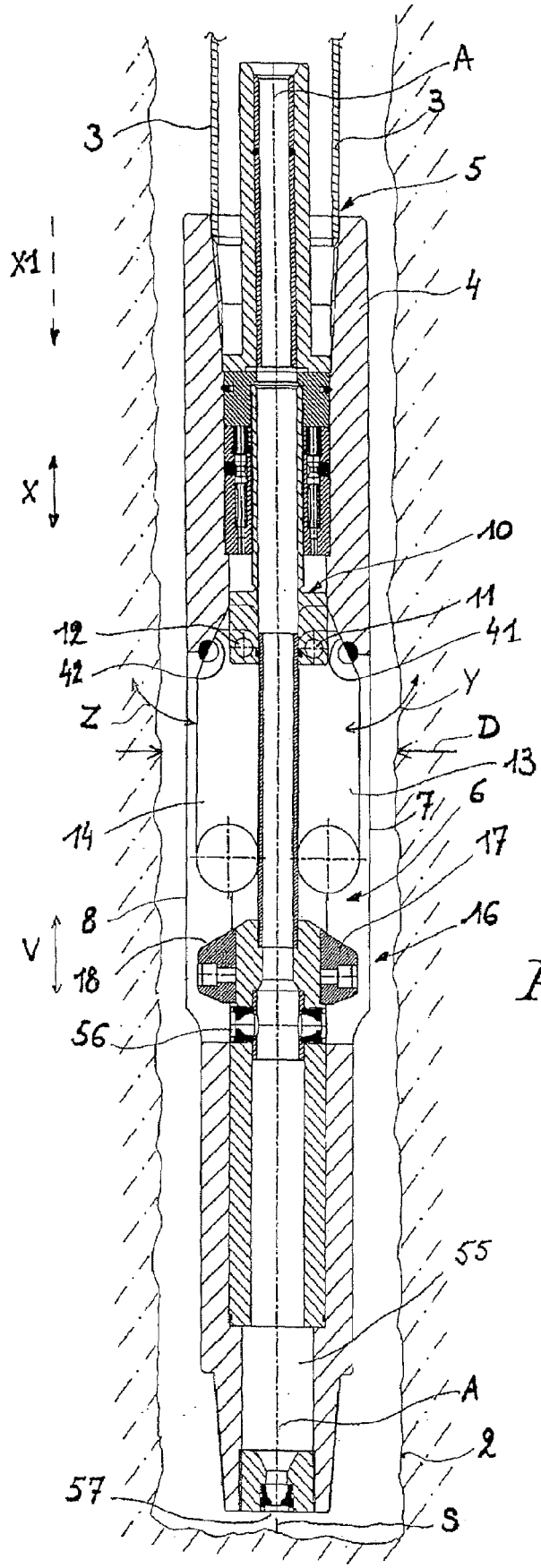
FIG. 1 is a schematic cross section view of a system of the invention with the cutting arms in a non working position.
Figure 2:
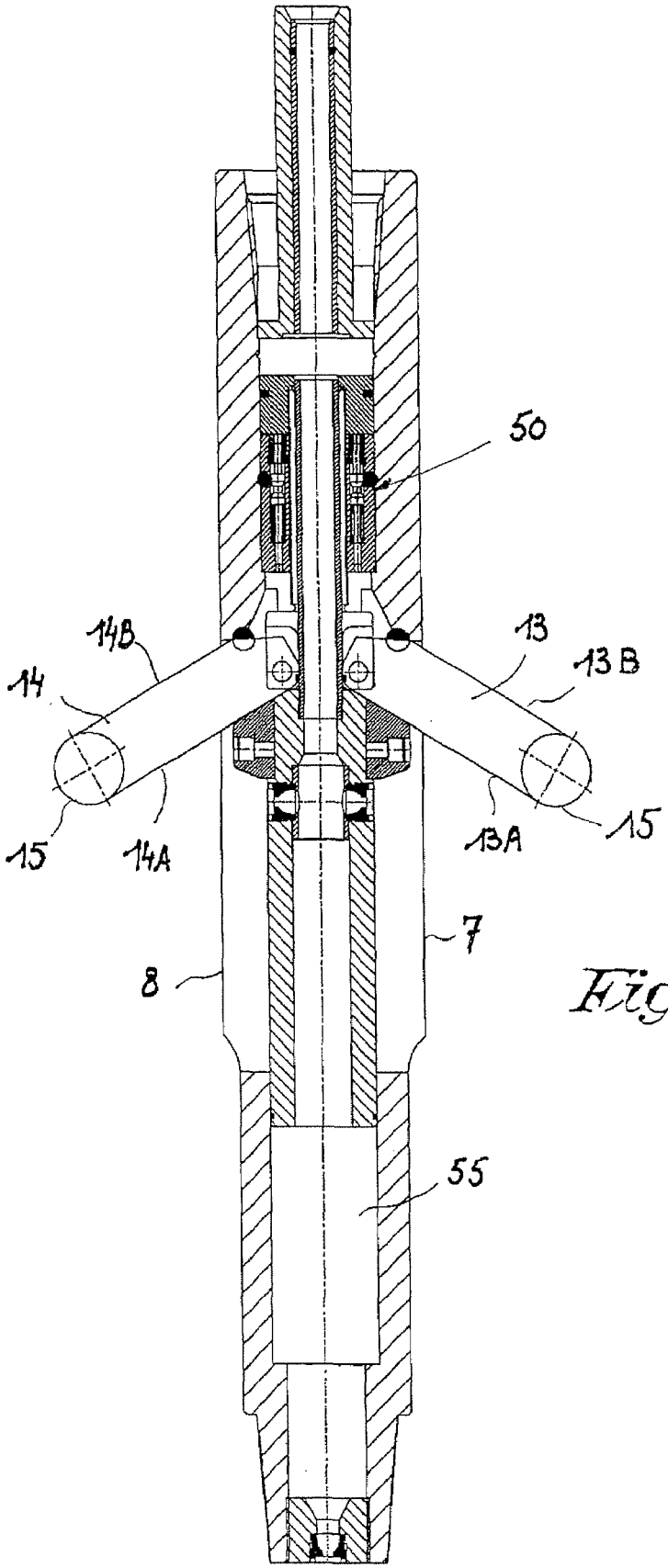
FIG. 2 is a view similar to FIG. 1 with the arms in cutting position.
Figure 3:
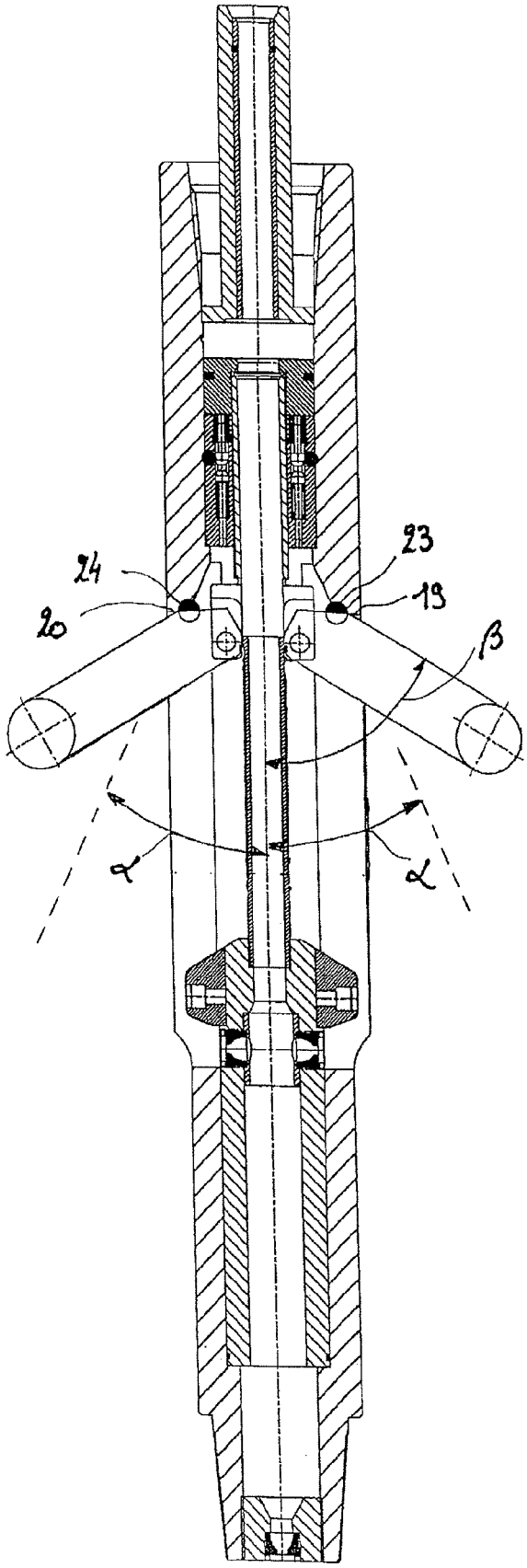
FIG. 3 is a view similar to FIG. 2 with the release of the blocking means.

The tool shown in FIG. 1 is a system 1 for increasing the diameter D of at least a portion of a well bore 2, said system 1 being attached to a drill pipe 3 (the end of the drill pipe being for example screwed in a screwed end of the system 1), said system comprising:

a longitudinal substantially cylindrical body 4 extending in a longitudinal direction (axis A—A corresponding substantially to the central axis of the well bore 2), said body 4 being provided with means 5 for attaching said body 4 to the drill pipe 3 and having at least one inner chamber 6 and two lateral openings 7,8 (opposite to each other, and symmetrical with respect to the axis A—A);

a support element or carrier 10 mounted movable with respect to the body 4 in the longitudinal direction A—A of the body 4 (arrow X), said support element 10 comprising a first shaft 11 and a second shaft 12 parallel to each other and perpendicular to the longitudinal direction A—A of the body 4, said element 10 being located in the chamber 6 of the body 4, the shafts 11,12 being fixed and not movable with respect to the element 10;

two arms 13,14 provided with cutting means 15 (such as carbide elements, diamond, artificial diamond, etc.), a first arm 13 being pivotably mounted on the shaft 11 (an axis of rotation perpendicular to the longitudinal direction of the body—arrow Y), while the second arm 14 is pivotably mounted on the shaft 12 (axis of rotation parallel to the axis of rotation of the first arm—arrow Z, each arm 13,14 pivoting with respect to the support element 10 between a first position in which the arm 13,14 extends in the chamber 6 (position of FIGS. 1 and 4) and a second position in which at least a portion of the cutting means 15 extends outside the chamber 6 after passing through an opening 7,8 of the body 4 (position of FIGS. 2 and 3—the pivotment of the arms 13,14 from the first position towards the second position is only possible after a downwards movement X1 of the element 10 into the chamber 6);

a blocking means 16 provided with at least a first abutment portion 17 and a second abutment portion 18, said means 16 being mounted movable with respect to the body 4in the longitudinal direction A—A of the body (arrow V), said blocking means 16 extending in the chamber 6 of the body.

Each arm 13,14 when located in the chamber 6 has at least one first face 13A,14A (face bearing cutting means 15) directed towards the longitudinal axis A—A of the body 4 and at least one second face 13B,14B directed opposite to the longitudinal axis of the body or directed towards an opening 7,8. When the arms 13, 14 are in the chamber 6, the faces 13A,14A are facing each other.

The chamber 6 of the body 4 has a first face 19 inclined with respect to the longitudinal direction A—A of the body 4 (face adjacent to the upper end of the chamber), said face 19 acting as abutment for the second face 13B (more precisely for a portion of said face) of the first arm 13 when extending in its second position (FIG. 2), and a second face 20 inclined with respect to the longitudinal direction A—A of the body, said face 20 acting as abutment for the second face 14B (more precisely for a portion of said face) of the second arm 14 when extending in its second position (FIG. 2).

The first abutment portion 17 has an abutment face parallel to the first face or a portion thereof 13A of the first arm 13 when extending in its second position, while the second abutment portion 18 has an abutment face parallel to the first face of the second arm 14 when extending in its second position.

Figure 5:
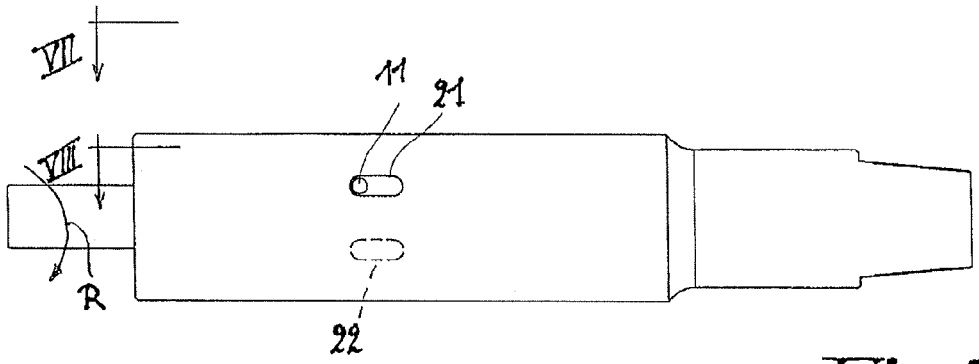
FIG. 5 is a front view of the system of FIG. 1.
Figure 6:
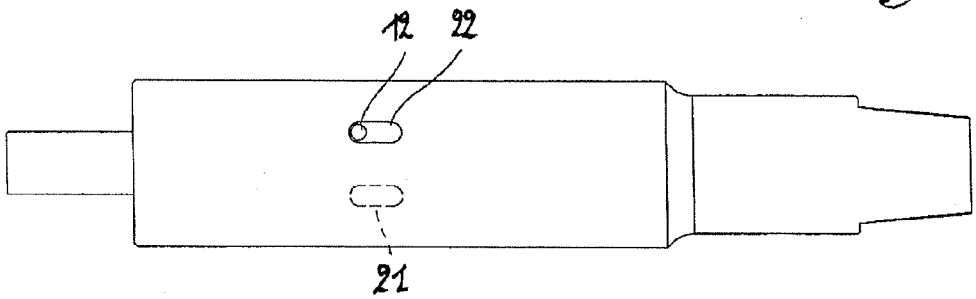
FIG. 6 is a back view of the system of FIG. 1.

FIGS. 5 and 6 are respectively a front view and a back view of the system or underreamer 1 shown in cross section in FIG. 1. The body 4 is provided with two grooves 21,22. An end of the shaft 11 of the arm 13 extends in the groove 21, while an end of the shaft 12 of the arm 14 extends in the groove 22. Said ends contact at least a face of the groove 21,22, so that when the drill pipe is rotated (arrow R), a pushing force is exerted on the end of the shaft. The grooves 21,22 act also as further means for ensuring a guiding of the movement of the support 10. Preferably, each shaft 10,11 has only one end inserted in a groove of the body so as to ensure that part of the effort or stresses is taken by the support 10. Advantageously, the shafts 11 and 12 are able to rotate (preferably substantially freely) with respect to the support 10, while the arms 13,14 are able to rotate (preferably substantially freely) respectively with respect to the shaft 11 and the shaft 12.

Figure 7:
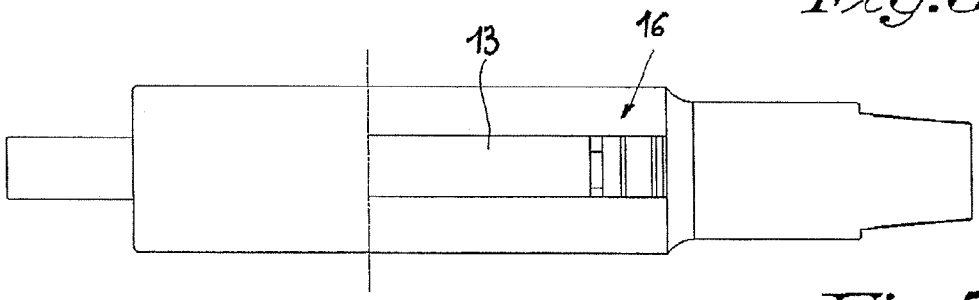
FIG. 7 is a lateral view along the lines VII—VII of the system of FIG. 5.
Figure 8:
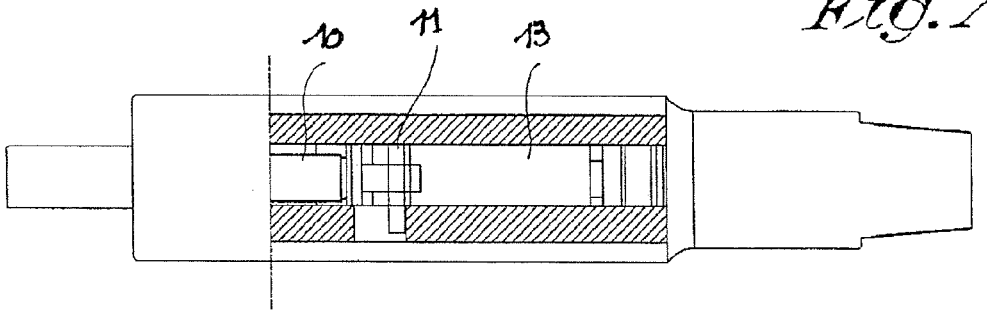
FIG. 8 is a section view along the lines VIII—VIII of the system of FIG. 5.

FIG. 7 is a lateral view along the lines VII—VII of FIG. 5, while FIG. 8 is a section view along the lines VIII—VIII of FIG. 5.

The body is further provided with a first means 23 pivotably mounted with respect to the body around an axis parallel to the axis of pivotment (the shaft 11) of the first arm 13, said first means 23 having a flat surface adapted to contact a flat portion of the second face 13B of the first arm 13 at least when the first arm extends partly outside of the opening between its first position and its second position, and a second means 24 pivotably mounted with respect to the body 4 around an axis parallel to the axis of pivotment (shaft 12) of the second arm 14, said second means 24 having a flat surface adapted to contact a flat portion of the second face of the second arm 14 at least when the second arm extends partly outside of the opening between its first position and its second position.

Figure 9:
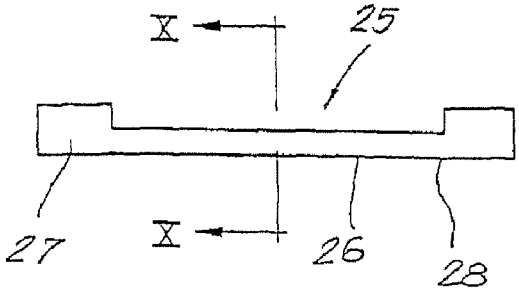
FIG. 9 is a view of a pivoting means on which a face of an arm abuts.
Figure 10:
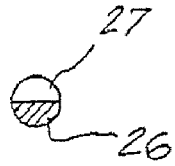

Said means 23,24 have for example the shape of a rod 25 having a central portion 26 extending between the ends 27,28, said central portion 26 having a cross section corresponding to the half of the circular cross section of the end 27,28. Said central portion has a flat surface 26A suitable to contact a portion of the second face of an arm. The ends 27,28 are inserted in holes of the body 4 and are adapted for enabling a substantially free pivotment or rotation of the rod with respect to the body. (see FIGS. 9 and 10)

The blocking means 17 is advantageously provided with a first means 29 pivotably mounted with respect to the blocking means 17 around an axis parallel to the axis of pivotment (shaft 11) of the first arm 13, said first means 29 having a flat surface 30 adapted to contact a flat portion of the first face 13A of the first arm at least when the first arm is blocked partly outside of the opening between its first position and its second position, and a second means 31 pivotably mounted with respect to the blocking means 17 around an axis parallel to the axis of pivotment (shaft 12) of the second arm, said second means having a flat surface 32 adapted to contact a flat portion of the first face of the second arm 14 at least when the second arm is blocked partly outside of the opening between its first position and its second position.

Figure 11:
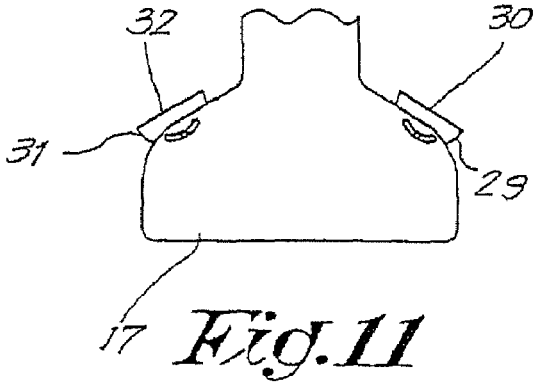
FIG. 11 is a view of an embodiment of a blocking means.
Figure 13:
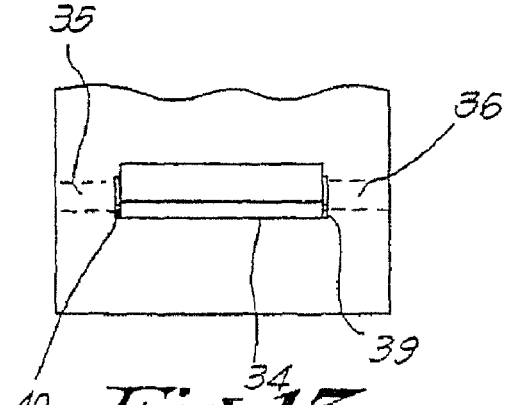
FIG. 13 is a lateral view of the blocking means of FIG. 11.
Figure 12:
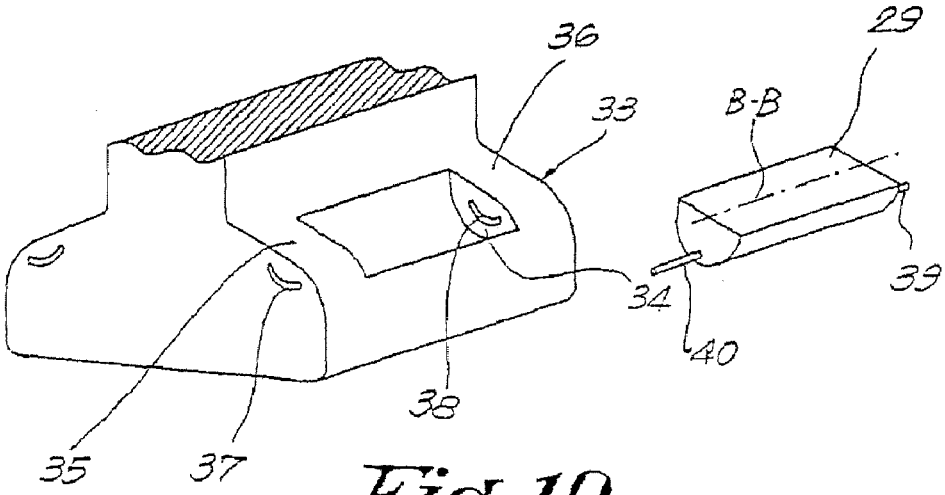
FIG. 12 is an exploded perspective view of the blocking means of FIG. 11.

The blocking means comprises a body 33 provided with a first recess 34 adapted for receiving the first means 29 and a second recess 34 for receiving the means 31. Said recesses 34 extend between two legs 35,36, said legs having two grooves 37, 38 having a form corresponding to a portion of a circular path. The means 29, 31 have the form of a half cylinder provided on its lateral face with a pin 39,40, intended to be inserted in a groove respectively 37,38. The pins 39,40 and the grooves 36,37 are agenced so that the body 33 is able to rotate around the central axis B—B of the cylinder corresponding to twice half cylinders. (see FIGS. 11 to 13).

In the embodiment shown, the second face 13B of the first arm 13 comprises a flat portion which is parallel to and contacts a third inclined face 41 of the chamber 6 when the first arm extends in its first position (said face 41 being adjacent to an upper edge of the axis A—A), while the second face 14B of the second arm 14 comprises a flat portion which is parallel to and contacts a fourth inclined face 42 of the chamber 6 when the second arm 14 extends in its first position (said face 42 being adjacent to an upper edge of the axis A—A).

The first means 23 pivotally mounted on the body 4 is located between the first inclined face 19 of the body 4 and the third inclined face 41of the body 4, while the second means 24 pivotally mounted on the body 4 is located between the second inclined face 20 of the body and the fourth inclined face 42 of the body.

The inclination (angle β) of the first and second inclined faces with respect to the longitudinal axis A—A (with respect to the axial symmetrical plane S) of the body 4 is about 75°, while the inclination (angle α) of the third and fourth inclined faces with respect to the longitudinal axis of the body is about 30°.

Figure 14:
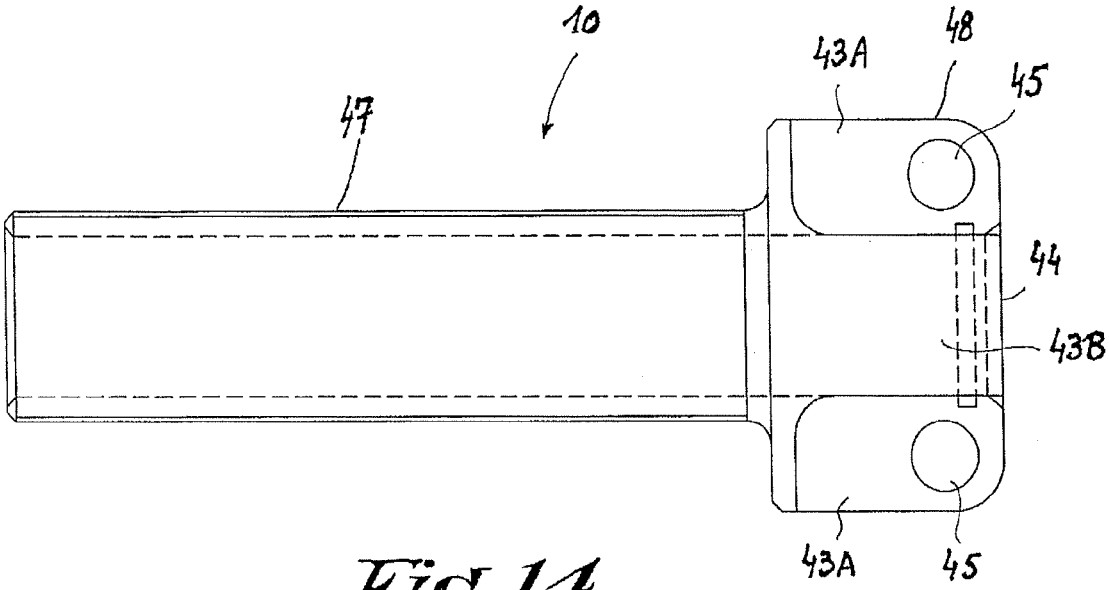
FIG. 14 is a view of a detail of the support element for the arms.
Figure 15:
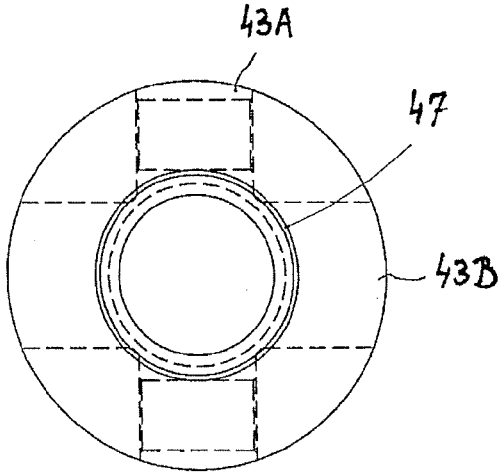
FIG. 15 is an upper view of the element of FIG. 14.
Figure 16:
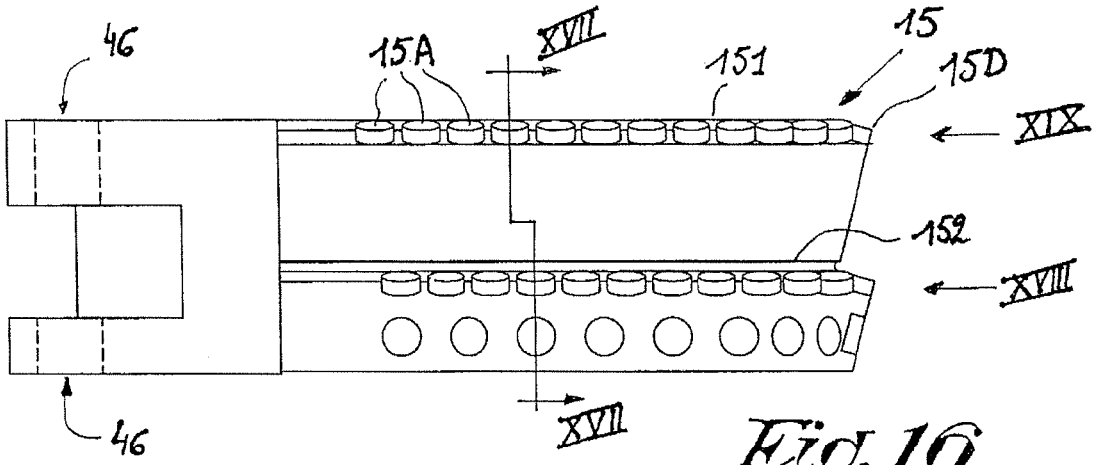
FIG. 16 is a view of an arm provided with two rows of cutting means.
Figure 18:
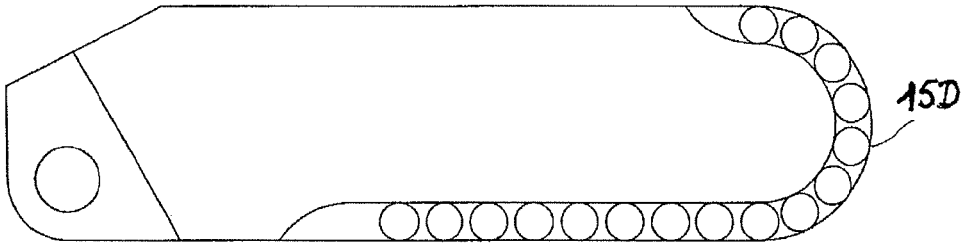
FIG. 18 is a view of a first row of cutting means (line XVIII)
Figure 19:
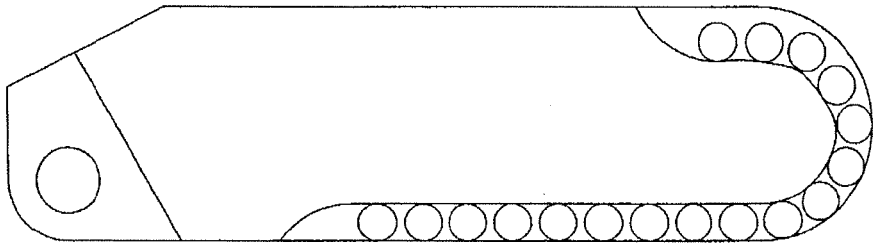
FIG. 19 is a view of a second row of cutting means (line XIX)
Figure 17:
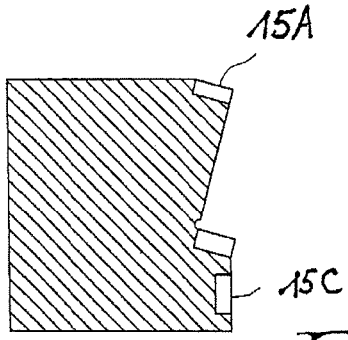
FIG. 17 is a cross section view of the arm of FIG. 16 along the line XVII—XVII.

A detail of the end of the support 10 is shown in FIGS. 14 and 15. As it can be seen, said end comprises a hollow pipe 47 provided with a head 48, said head having four plates 43A, 43B forming a cross with a central opening 44. The plates 43A is inserted between two legs 46 of the arm 13,14 provided with cutting means 15. An arm provided with two rows of cutting means 15 is shown in FIG. 16. The diamonds 15A of the first row 151 are placed with respect to the circular cutting paths of the diamonds 15B of the second row 152 so that the diamonds 15A act on a portion of the face of the well which is located between two adjacent cutting zones with the diamonds 15B. The arm 13,14 is also provided with diamonds 15C on its lateral face and with diamonds 15D at the free curved end of the arm. The legs 46 are provided with a passage in which a portion of a shaft 11,12 is inserted. (see FIGS. 16 to 19)

The system is also provided with means for controlling the movement of the support 10 and the blocking means 17. As the system is provided with pivoting means 23,24, 29,31, it is possible to block the arm in an intermediate position between the first position and the second position. The controlling means 50 is for example adapted for varying substantially continuously the position of the arms, and thus the enlargement of the well bore.

For increasing the diameter of a well bore, such as a petrol well bore, the system of FIG. 1 is mounted at the end of a drill pipe, and a stabilizer is attached to the system of the invention. The system is engaged in the drill pipe with the arms 13,14 located in the chamber 6.

The controlling means (comprising jacks 50A acting against the action of springs) is actuated so as to move downwards X1 the support 10 with respect to the body 4. The support 10 is placed in a position corresponding to the required inclination of the arms (i.e. for having the required enlargement diameter). When the support is in position corresponding to the desired enlargement, the blocking means is moved upwardly (the flow of fluid containing bentonite flow within the chamber 55, whereby the volume of said chamber 55 is expanded. The fluid escapes the chamber 55 through nozzles 56,57. During the upwards movement of the blocking means 17, the pipe 58 attached to the blocking means is moved upwardly in the central passage of the support 10.) so as to contact the arm and to block them between the means 23,24 and the means 29,31. The rotation of the drill pipe 3 will cause the rotation of the system 1 and of the arms 13,14, whereby the cutting element will cause an enlargement of the bore. The stabiliser is advantageously used for causing or facilitating the downwards movement of the system in the well bore. During the cutting operation, a fluid (advantageously containing a bentonite) is injected below the cutting means for ensuring an upwards movement of the particles and stones produced during the cutting.

As it is possible to have good blocking for intermediate positions of the arms, it is possible to adapt as required the enlargement. It is therefore possible to make without having to change of cutting system, a well bore having various portions with different diameter. The arms 13,14 form advantageously an angle with respect to the axis A—A, when the arms are in cutting position, said angle being advantageously comprised between 30° and 80°, preferably between 45° and 70°.

Figure 4:
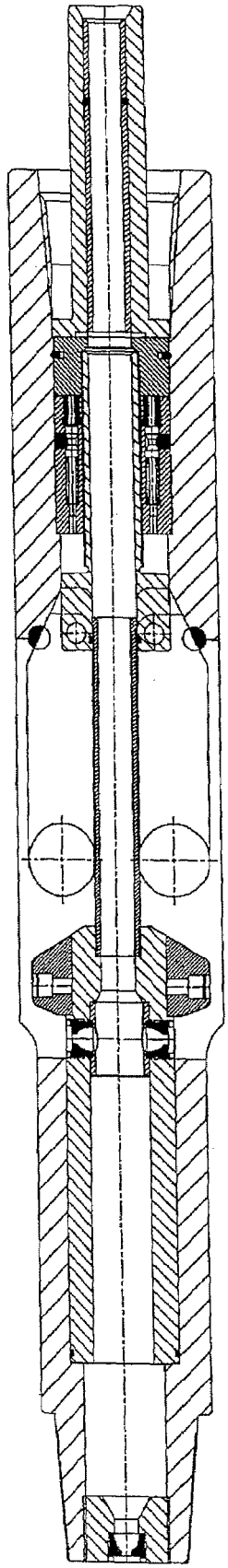
FIG. 4 is a view similar to FIG. 1 when the system is removed out of the well.

At the end of the cutting, the blocking means is moved downwardly (no or substantially no bentonite flow being made) (FIG. 3). Thereafter the controlling means act on the jacks for moving upwardly the support 10, whereby the arm 13, 14 are blocked within the chamber 6 (FIG. 4).

The system of claim 1, in which the first arm has a protuberance with a lateral end face corresponding to a portion of the lateral face of a cylinder centered with respect to axis of pivotment of the arm with respect to the support element, while the second arm has a protuberance with a lateral end face corresponding to a portion of the lateral face of a cylinder centered with respect to axis of pivotment of the second arm with respect to the support element, the support element having a first recess in which the first protuberance extends and a second recess in which the second protuberance extends, said first recess having a face contacting at least partly the lateral end face of the protuberance of the first arm, while said second recess has a face contacting at least partly the lateral end face of the protuberance of the second arm.

Figure 20:
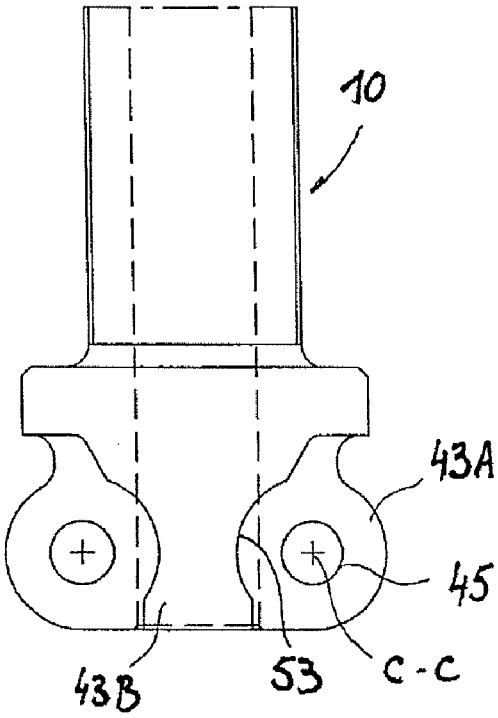
FIG. 20 is a view of a detail of an embodiment of a support for arms.
Figure 22:
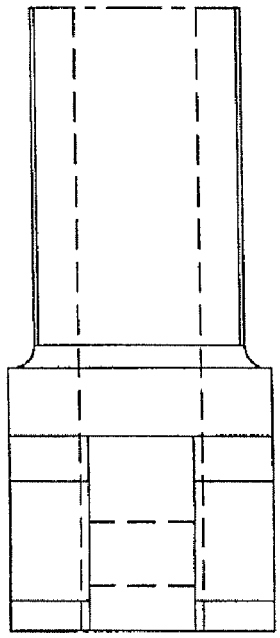
FIG. 22 is a lateral view of the support of FIG. 20.
Figure 21:
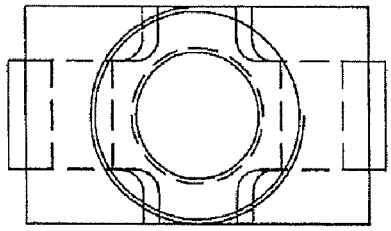
FIG. 21 is an upper view of the support of FIG. 20.

FIGS. 20 and 21 are view of a detail of a preferred embodiment of a movable support 10. The plates 43A provided with the passage 45 for a shaft 11,12 on which is mounted an arm 13,14 are associated with an extension 52 of the plates 43B. Said extension is provided with an end face 53 having the shape of a portion of a cylinder centered with respect to the axis C—C of the passage 45. Each plate 43A is associated with two extension 52, one on the left side, the other on the right side.

The support 10 of FIG. 20 is adapted to cooperate with arms 13,14 with legs having end face following a portion of a cylinder, said end face contacting the end face 53.

The control means 50 of FIG. 1 can be replaced by a control means actuated by the flow rate of liquid through the drill pipe, whereby the system can be operated without problem from the ground.

The control means 50 shown in FIG. 23 comprises an outer hollow cylinder 60, an indexer 61 located in said hollow cylinder 60, said indexer having a central channel 62 ending in a smaller channel 63 and having two side channels 64 at the junction J of the channels 62 and 63. A rod 65 extends at least in the channel 63, said rod being attached to the cylinder 60 by a shaft 67. A carrier 68 is movable along the rod 65, said carrier extending with a rod 69 bearing at its end a plate 70 connected to the support 10. A spring 71 extend between the plate 70 and a support element 72 attached to the cylinder 60.

The plate 70 is connected to the support element by means of a jack or cylinder or a rod (not shown) for actuating the movement of the support 10. According to a possible embodiment, the jack or cylinder located between the plate 70 and the support element can be independently actuated, so as to control the position of the support. In this latter case, the movement of the plate ensures for example the movement of the support 10 between a position ensuring a minimum possible pivotment of the arms (pivotment operated for example when the closing means 16 abut against the arms) and a position preventing any pivotment of the arms, while the jack or cylinder actuates the movement of the element 10 so as to control the possible pivotment of the arms between a minimum possible pivotment and a maximum pivotment position.

Figure 25:
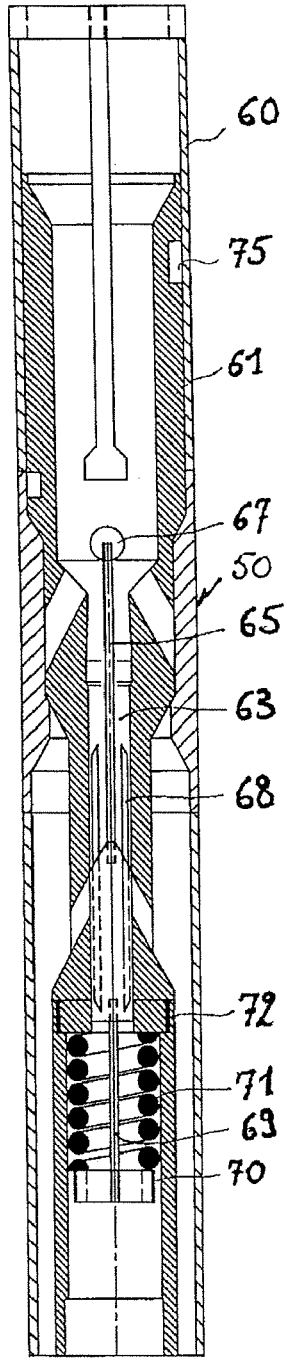
FIG. 25 is a development view of the groove of the indexer.
Figure 24:
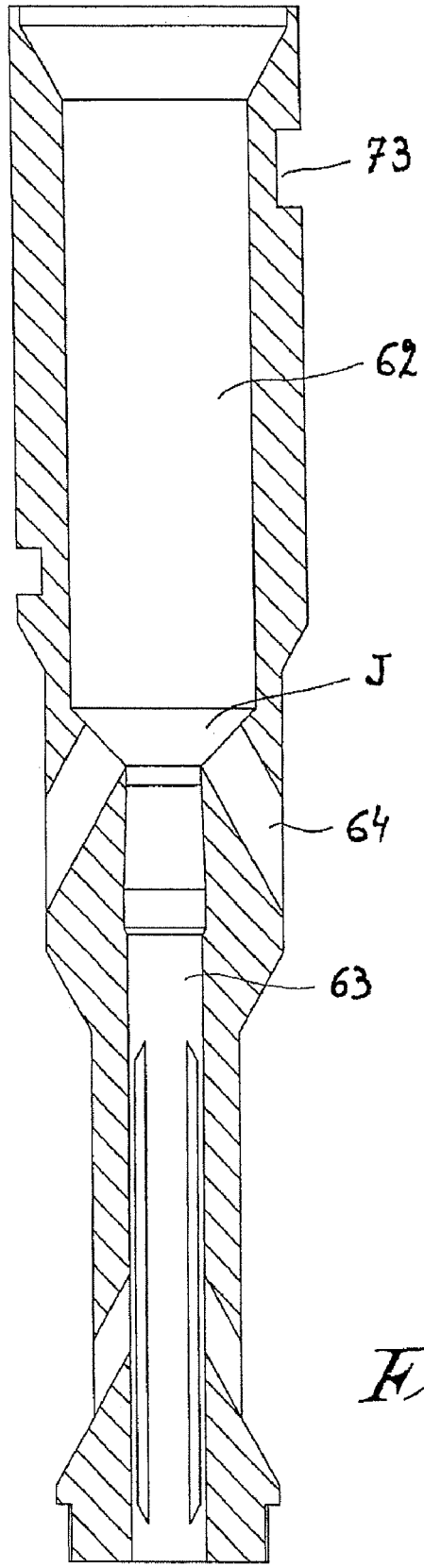
FIG. 24 is a view of the indexer.
Figure 25:
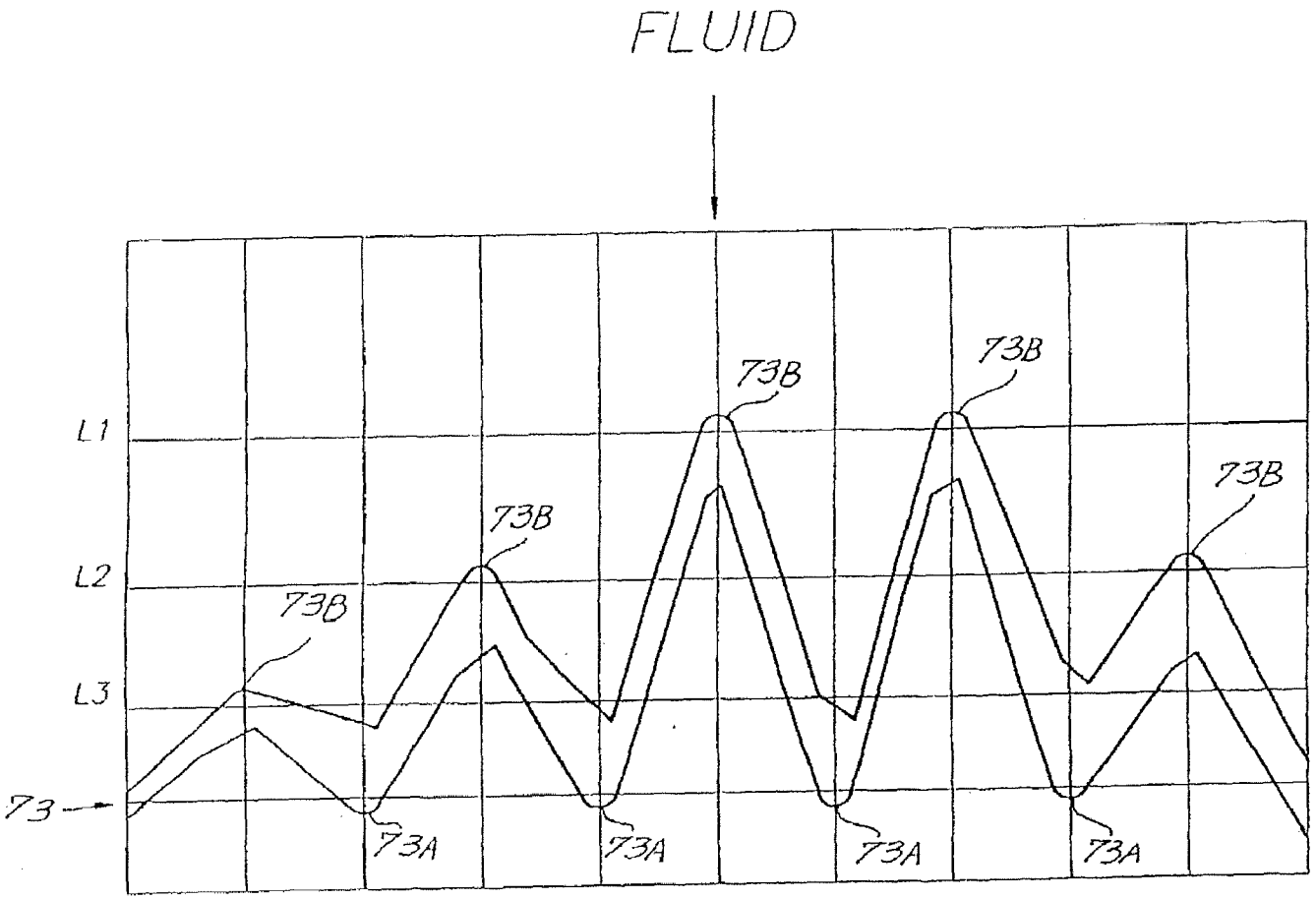

The cylinder 61 is provided with a lateral groove 73, the development of which is shown in FIG. 25. Said groove 73 has valleys 73A substantially at a same level and peaks 73B situated at different levels, level L1 for the closing position of the arm 13,14 (upwards movement of the support 10), level L2 for measuring the opening angle of the arms 13,14 or for positioning the arms, and Level L3 for the working position. A pin 75 attached to the cylinder 60 moves in said groove 73.

In FIG. 23, the indexer 61 is in position closing the arms 13,14 into the chamber 6. In said position, the fluid FL flows in the channel 63, whereby the indexer is moved downwardly against the action of the spring 71. In this position, no fluid FL flows through the passages 64.

Figure 26:
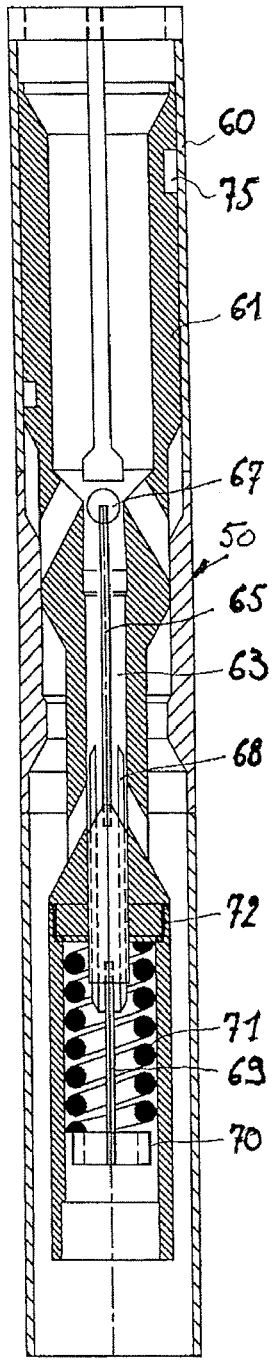

In FIG. 26, the indexer is in position for measuring and/or adapting the dimension of the enlargement, i.e. the diameter D or the angle of the arm 13,14.

Figure 27:
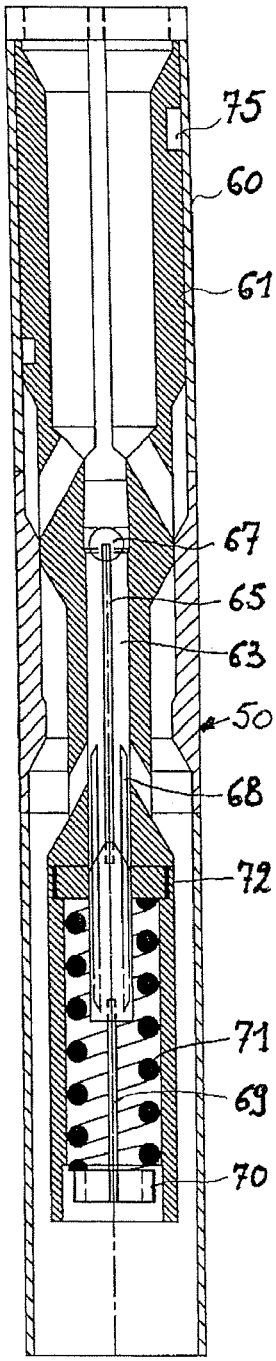
FIGS. 26 and 27 are views similar to that of FIG. 23, with the indexer in different positions.

In FIG. 27, the indexer or indexing means is in position for the working of the system for enlarging the diameter of the bore. In this position, the fluid flows through the passage 64.

For passing from one position to another position, the flow rate of fluid is increased so as to move downwardly the indexer 61 against the action of the spring 71, so that the finger or pin 75 is moved in a valley 73A. When reducing the flow rate to the nominal flow rate, the spring acts on the indexer so that the pin 75 extends in a peak of the indexer.

The invention claimed is:

1. A system for increasing the diameter of at least a portion of a well bore, said system being intended to be attached to a drill pipe, said system comprising:

a longitudinal substantially cylindrical body extending in a longitudinal direction, said body being provided with means adapted for attaching said body to the drill pipe and having at least one chamber and two openings;

a support element movably mounted with respect to the body in the longitudinal direction of the body, said support comprising a first shaft and a second shaft parallel to each other and perpendicular to the longitudinal direction of the body, said element being located in the chamber of the body;

first and second arms provided with cutting means, the first arm being pivotably mounted on the support element around an axis of pivotment perpendicular to the longitudinal direction of the body, while the second arm is pivotably mounted on the support element around an axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body; and a blocking means provided with at least a first abutment portion and a second abutment portion, said means being movably mounted with respect to the body in the longitudinal direction of the body;

in which each of said first and second arms when located in the chamber has at least one first face directed towards the longitudinal axis of the body and at least one second face directed opposite to the longitudinal axis of the body, in which the chamber of the body has a first face inclined with respect to the longitudinal direction of the body, said first face of the chamber acting as an abutment contacting the second face of the first arm when said first arm extends in said second position, and a second face inclined with respect to the longitudinal direction of the body, said second face of the chamber acting as an abutment contacting the second face of the second arm when said second arm extends in said second position, and in which the first abutment portion of the blocking means has an abutment face parallel to the first face of the first arm and contacting said first face of the first arm, when said first arm extends in said second position, while the second abutment portion of the blocking means has an abutment face parallel to the first face of the second arm and contacting said first face of the second arm, when said second arm extends in said second position.

2. The system of claim 1, in which the second face of the first arm comprises a flat portion which is parallel to and contacts a third inclined face of the chamber when the first arm extends in said first position of the first arm, while the second face of the second arm comprises a flat portion which is parallel to and contacts a fourth inclined face of the chamber when the second arm extends in said first position of the second arm.

3. The system of claim 1, in which the first arm has a protuberance with a lateral end face corresponding to a portion of the lateral face of a cylinder centered with respect to the axis of pivotment of the arm with respect to the support element, while the second arm has a protuberance with a lateral end face corresponding to a portion of the lateral face of a cylinder centered with respect to the axis of pivotment of the second arm with respect to the support element, the support element having a first recess in which the first protuberance extends and a second recess in which the second protuberance extends, the first recess having a face contacting at least partly the lateral end face of the protuberance of the first arm, while the second recess has a face contacting at least partly the lateral end face of the protuberance of the second arm.

4. The system of claim 1, in which the support element is provided with a central longitudinal passage in which a rod extends, said rod bearing the blocking means.

5. The system of claim 1, which further comprises a means for controlling the relative longitudinal movement of the support element with respect to the body and the relative longitudinal movement of the blocking means with respect to the body.

6. The system of claim 5, in which the controlling means comprises an indexer with various positions selected from the group consisting of working position, closing position, measuring position and adapting position.

7. The system of claim 1, which further comprises a stabilizing means.

8. A system for increasing the diameter of at least a portion of a well bore, said system being intended to be attached to a drill pipe, said system comprising:

a longitudinal substantially cylindrical body extending in a longitudinal direction, said body being provided with means for attaching said body to the drill pipe and having at least one chamber and two openings;

said body being provided with:

a first means pivotably mounted with respect to the body around an axis parallel to the axis of pivotment of the first arm, said first means having a flat surface adapted to contact a flat portion of the second face of the first arm at least when the first arm extends partly outside of the opening between its first position and its second position, and a second means pivotably mounted with respect to the body around an axis parallel to the axis of pivotment of the second arm, said second means having a flat surface adapted to contact a flat portion of the second face of the second arm at least when the second arm extends partly outside of the opening between its first position and its second positions, a support element movably mounted with respect to the body in the longitudinal direction of the body, said support comprising a first shaft and a second shaft parallel to each other and perpendicular to the longitudinal direction of the body, said element being located in the chamber of the body;

first and second arms provided with cutting means, the first arm being pivotably mounted on the support element around an axis of pivotment perpendicular to the longitudinal direction of the body, while the second arm is pivotably mounted on the support element around an axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body; and a blocking means provided with at least a first abutment portion and a second abutment portion, said means being movably mounted with respect to the body in the longitudinal direction of the body;

in which each of said first and second arms when located in the chamber has at least one first face directed towards the longitudinal axis of the body and at least one second face directed opposite to the longitudinal axis of the body, in which the chamber of the body has a first face inclined with respect to the longitudinal direction of the body, said first face of the chamber acting as an abutment for the second face of the first arm when said first arm extends in said second position, and a second face inclined with respect to the longitudinal direction of the body, said second face of the chamber acting as an abutment for the second face of the second arm when said second arm extends in said second position, and in which the first abutment portion of the blocking means has an abutment face parallel to the first face of the first arm when said first arm extends in said second position, while the second abutment portion of the blocking means has an abutment face parallel to the first face of the second arm when said second arm extends in said second position.

9. The system of claim 8, in which the first means pivotally mounted on the body is located between the first inclined face of the body and a third inclined face of the body, while the second means pivotally mounted on the body is located between the second inclined face of the body and a fourth inclined face of the body, the inclination of the first and second inclined faces with respect to the longitudinal axis of the body being comprised between 60° and 90°, while the inclination of the third and fourth inclined faces with respect to the longitudinal axis of the body is comprised between 15° and 50°.

10. A system for increasing the diameter of at least a portion of a well bore, said system being intended to be attached to a drill pipe, said system comprising:

(a) a longitudinal substantially cylindrical body extending in a longitudinal direction, said body being provided with means for attaching said body to the drill pipe and having at least one chamber and two openings;

(b) a support element movably mounted with respect to the body in the longitudinal direction of the body, said support comprising a first shaft and a second shaft parallel to each other and perpendicular to the longitudinal direction of the body, said element being located in the chamber of the body;

(c) first and second arms provided with cutting means, the first arm being pivotably mounted on the support element around an axis of pivotment perpendicular to the longitudinal direction of the body, while the second arm is pivotably mounted on the support element around an axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body; and (d) a blocking means provided with at least a first abutment portion and a second abutment portion, said means being movably mounted with respect to the body in the longitudinal direction of the body; whereby the blocking means is provided with;

a first means pivotably mounted with respect to the body around an axis parallel to the axis of pivotment of the first arm, said first means having a flat surface adapted to contact a flat portion of the first face of the first arm at least when the first arm is blocked partly outside of the opening between its first position and its second position, and a second means pivotably mounted with respect to the blocking means around an axis parallel to the axis of pivotment of the second arm, said second means having a flat surface adapted to contact a flat portion of the first face of the second arm at least when the second arm is blocked partly outside of the opening between its first position and its second position.

11. A system for increasing the diameter of at least a portion of a well bore, said system being intended to be attached to a drill pipe, said system comprising:

(a) a longitudinal substantially cylindrical body extending in a longitudinal direction, said body being provided with means adapted for attaching said body to the drill pipe and having at least one chamber and two openings;

(b) a support element movably mounted with respect to the body in the longitudinal direction of the body, said support comprising a first shaft and a second shaft parallel to each other and perpendicular to the longitudinal direction of the body, said element being located in the chamber of the body;

(c) first and second arms provided with cutting means, the first arm being pivotably mounted on the support element around an axis of pivotment perpendicular to the longitudinal direction of the body, while the second arm is pivotably mounted on the support element around an axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body; and (d) a blocking means provided with at least a first abutment portion and a second abutment portion, said means being movably mounted with respect to the body in the longitudinal direction of the body;

in which each of said first and second arms when located in the chamber has at least one first face directed toward the longitudinal axis of the body and at least one second face directed opposite to the longitudinal axis of the body, in which the chamber of the body has a first face inclined with respect to the longitudinal direction of the body, said first face of the chamber acting as an abutment for the second face of the first arm when said first arm extends in said second position, and a second face inclined with respect to the longitudinal direction of the body, said second face of the chamber acting as an abutment for the second face of the second arm when said second arm extends in said second position, and in which the first abutment portion of the blocking means has an abutment face parallel to the first face of the first arm when said first arm extends in said second position, while the second abutment portion of the blocking means has an abutment face parallel to the first face of the second arm when said second arm extends in said second position of the second arm, said body being provided with:

a first means pivotably mounted with respect to the body around an axis parallel to the axis of pivotment of the first arm, said first means having a flat surface adapted to contact a fiat portion of the second face of the first arm at least when the first arm extends partly outside the opening between its first position and its second position, said flat surface forming an extension of the first face when the second face of the first arm abuts the first inclined face of the body, and a second means pivotably mounted with respect to the body around an axis parallel to the axis of pivotment of the second arm, said second means having a flat surface adapted to contact a flat portion of the second face of the second arm at least when the second arm extends partly outside of the opening between its first position and its second position, said flat surface forming an extension of the second inclined face of the body when the second face of the second arm abuts the second inclined face of the body.

12. The system of claim 11, in which the first means pivotally mounted on the body is located between the first inclined face of the body and a third inclined face of the body, while the second means pivotally mounted on the body is located between the second inclined face of the body and a fourth inclined face of the body.

13. A drill pipe provided with a system for increasing the diameter of at least a portion of a well bore, said system comprising:

a longitudinal substantially cylindrical body extending in a longitudinal direction, said body being provided with means for attaching said body to the drill pipe and having at least one chamber and two openings;

a support element movably mounted with respect to the body in the longitudinal direction of the body, said support comprising a first shaft and a second shaft parallel to each other and perpendicular to the longitudinal direction of the body, said element being located in the chamber of the body;

first and second arms provided with cutting means, a first arm being pivotably mounted on the support element around an axis of pivotment perpendicular to the longitudinal direction of the body, while the second arm is pivotably mounted on the support element around an axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body;

a blocking means provided with at least a first abutment portion and a second abutment portion, said means being movably mounted with respect to the body in the longitudinal direction of the body;

in which each of said first and second arms when located in the chamber has at least one first face directed towards the longitudinal axis of the body and at least one second face directed opposite to the longitudinal axis of the body, in which the chamber of the body has a first face inclined with respect to the longitudinal direction of the body, said first face of the chamber acting as an abutment contacting the second face of the first arm when said first arm extends in said second position, and a second face inclined with respect to the longitudinal direction of the body, said second face of the chamber acting as an abutment contacting the second face of the second arm when said second arm extends in said second position, and in which the first abutment portion of the blocking means has an abutment face parallel to the first face of the first arm and contacting said first face of the first arm, when said first arm extends in said second position, while the second abutment portion of the blocking means has an abutment face parallel to the first face of the second arm and contacting said first face of the second arm, when said second arm extends in said second position.

14. The drill pipe of claim 13, in which the second face of the first arm of the system comprises a flat portion which is parallel to and contacts a third inclined face of the chamber when the first arm extends in its first position, while the second face of the second arm comprises a flat portion which is parallel to and contacts a fourth inclined face of the chamber when the second arm extends in its first position.

15. The drill pipe of claim 13, in which the first arm of the system has a protuberance with a lateral end face corresponding to a portion of the lateral face of a cylinder centered with respect to axis of pivotment of the arm with respect to the support element, while the second arm has a protuberance with a lateral end face corresponding to a portion of the lateral face of a cylinder centered with respect to axis of pivotment of the second arm with respect to the support element, the support element having a first recess in which the first protuberance extends and a second recess in which the second protuberance extends, said first recess having a face contacting at least partly the lateral end face of the protuberance of the first arm, while said second recess has a face contacting at least partly the lateral end face of the protuberance of the second arm.

16. The drill pipe of claim 13, in which the support element of the system is provided with a central longitudinal passage in which a rod extends, said rod bearing the blocking means.

17. The drill pipe of claim 13, which further comprises a means for controlling the relative longitudinal movement of the support element of the system with respect to the body of the system and the relative longitudinal movement of the blocking means with respect to the body of the system.

18. The drill pipe of claim 17, in which the controlling means of the system comprises an indexer with various positions selected from among the group consisting of working position, closing position, measuring position and adapting position.

19. The drill pipe system of claim 13, which further comprises a stabilizing means.

20. A drill pipe provided with a system for increasing the diameter of at least a portion of a well bore, said system comprising:

a) a longitudinal substantially cylindrical body extending in a longitudinal direction, said body being provided with means adapted for attaching said body to the drill pipe and haying at least one chamber and two openings, said body of the system being provided with:

a first means pivotably mounted with respect to the body around an axis parallel to the axis of pivotment of the first arm, said first means having a flat surface adapted to contact a flat portion of the second face of the first arm at least when the first arm extends partly outside of the opening between its first position and its second position, and a second means pivotably mounted with respect to the body around an axis parallel to the axis of pivotment of the second arm, said second means having a flat surface adapted to contact a flat portion of the second face of the second arm at least when the second arm extends partly outside of the opening between its first position and its second positions, b) a support element movably mounted with respect to the body in the longitudinal direction of the body, said support comprising a first shaft and a second shaft parallel to each other and perpendicular to the longitudinal direction of the body, said element being located in the chamber of the body;

c) first and second arms provided with cutting means, the first arm being pivotably mounted on the support element around an axis of pivotment perpendicular to the longitudinal direction of the body, while the second arm is pivotably mounted on the support element around axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body; and d) a blocking means provided with at least a first abutment portion and a second abutment portion, said means being movably mounted with respect to the body in the longitudinal direction of the body;

in which each of said first and second arms when located in the chamber has at least one first face directed towards the longitudinal axis of the body and at least one second face directed opposite to the longitudinal axis of the body, in which the chamber of the body has a first face inclined with respect to the longitudinal direction of the body, said first face of the chamber acting as an abutment for the second face of the first arm when said first arm extends in said second position, and a second face inclined with respect to the longitudinal direction of the body, said second face of the chamber acting as an abutment for the second face of the second arm when said second arm extends in said second position, and in which the first abutment portion of the blocking means has an abutment face parallel to the first face of the first arm when said first arm extends in said second position while the second abutment portion of the blocking means has an abutment face parallel to the first face of the second arm when said second arm extends in said second position.

21. A drill pipe provided with a system for increasing the diameter of at least a portion of a well bore, said system comprising:

a) a longitudinal substantially cylindrical body extending in a longitudinal direction, said body being provided with means adapted for attaching said body to the drill pipe and having at least one chamber and two openings, b) a support element movably mounted with respect to the body in the longitudinal direction of the body, said support comprising a first shaft and a second shaft parallel to each other and perpendicular to the longitudinal direction of the body, said element being located in the chamber of the body;

c) first and second arms provided with cutting means, the first arm being pivotably mounted on the support element around an axis of pivotment perpendicular to the longitudinal direction of the body, while the second arm is pivotably mounted on the support element around axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body; and d) a blocking means provided with at least a first abutment portion and a second abutment portion, said means being movably mounted with respect to the body in the longitudinal direction of the body; whereby the blocking means of the system is provided with:

a first means pivotably mounted with respect to the blocking means around an axis parallel to the axis of pivotment of the first arm, said first means having a flat surface adapted to contact a flat portion of the first face of the first arm at least when the first arm is blocked partly outside of the opening between its first position and its second position, and a second means pivotably mounted with respect to the blocking means around an axis parallel to the axis of pivotment of the second arm, said second means having a flat surface adapted to contact a flat portion of the first face of the second arm at least when the second arm is blocked partly outside of the opening between its first position and its second position.

22. A drill pipe provided with a system for increasing the diameter of at least a portion of a well bore, said system comprising:

a) a longitudinal substantially cylindrical body extending in a longitudinal direction, said body being provided with means adapted for attaching said body to the drill pipe and having at least one chamber and two openings, said body being provided with:

a first means pivotably mounted with respect to the body around an axis parallel to the axis of pivotment of the first arm, said first means having a flat surface adapted to contact a flat portion of the second face of the first arm at least when the first arm extends partly outside of the opening between its first position and its second position, said flat surface forming an extension of the first face when the second face of the first arm abuts the first inclined face of the body, and a second means pivotably mounted with respect to the body around an axis parallel to the axis of pivotment of the second arm, said second means having a flat surface adapted to contact a flat portion of the second face of the second arm at least when the second arm extends partly outside of the opening between its first position and its second position, said flat surface forming an extension of the second inclined face of the body when the second face of the second arm abuts the second inclined face of the body.

b) a support element movably mounted with respect to the body in the longitudinal direction of the body, said support comprising a first shaft and a second shaft parallel to each other and perpendicular to the longitudinal direction of the body, said element being located in the chamber of the body;

c) first and second arms provided with cutting means, the first arm being pivotably mounted on the support element around an axis of pivotment perpendicular to the longitudinal direction of the body, while the second arm is pivotably mounted on the support element around axis of pivotment parallel to the axis of pivotment of the first arm, said arm pivoting with respect to the support element between a first position in which the arm extends in the chamber and a second position in which at least a portion of the cutting means extends outside the chamber after passing through an opening of the body; and d) a blocking means provided with at least a first abutment portion and a second abutment portion, said means being movably mounted with respect to the body in the longitudinal direction of the body;

in which each of said first and second arms when located in the chamber has at least one first face directed towards the longitudinal axis of the body and at least one second face directed opposite to the longitudinal axis of the body, in which the chamber of the body has a first face inclined with respect to the longitudinal direction of the body, said first face of the chamber acting as an abutment for the second face of the first arm when said first arm extends in said second position, and a second face inclined with respect to the longitudinal direction of the body, said second face of the chamber acting as an abutment for the second face of the second arm when said second arm extends in said second position, and in which the first abutment portion of the blocking means has an abutment face parallel to the first face of the first arm when said first arm extends in said second position, while the second abutment portion of the blocking means has an abutment face parallel to the first face of the second arm when said second arm extends in said second position.

23. The drill pipe of claim 22, in which the first means pivotally mounted on the body of the system is located between the first inclined face of the body and a third inclined face of the body, while the second means pivotally mounted on the body is located between the second inclined face of the body and a fourth inclined face of the body.

24. The drill pipe of claim 22 in which the first means pivotally mounted on the body of the system is located between the first inclined face of the body and a third inclined face of the body, while the second means pivotally mounted on the body is located between the second inclined face of the body and a fourth inclined face of the body, the inclination of the first and second inclined faces with respect to the longitudinal axis of the body being comprised between 60° and 90°, while the inclination of the third and fourth inclined faces with respect to the longitudinal axis of the body is comprised between 15° and 50°.

25. A drilling process for increasing the diameter of at least a portion of a well bore, including the step of increasing the diameter of at said at least a portion of the well bore by drilling, wherein the drilling of the portion of the well bore which has to be increased is carried out by driving into rotation in the well bore a drill pipe provided with a system, said system comprising:

a longitudinal substantially cylindrical body extending in a longitudinal direction, said body being provided with means adapted for attaching said body to the drill pipe and having at least one chamber and two openings;

a support element movably mounted with respect to the body in the longitudinal direction of the body, said support comprising a first shaft and a second shaft parallel to each other and perpendicular to the longitudinal direction of the body, said element being located in the chamber of the body;

first and second arms provided with cutting means, a first arm being pivotably mounted on the support element around an axis of pivotment perpendicular to the longitudinal direction of the body, while the second arm is pivotably mounted on the support element around an axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body;

a blocking means provided with at least a first abutment portion and a second abutment portion, said means being movably mounted with respect to the body in the longitudinal direction of the body;

in which each of said first and second arms when located in the chamber has at least one first face directed towards the longitudinal axis of the body and at least one second face directed opposite to the longitudinal axis of the body, in which the chamber of the body has a first face inclined with respect to the longitudinal direction of the body, said first face of the chamber acting as an abutment contacting the second face of the first arm when said first arm extends in said second position, and a second face inclined with respect to the longitudinal direction of the body, said second face of the chamber acting as an abutment contacting the second face of the second arm when said second arm extends in said second position, and in which the first abutment portion of the blocking means has an abutment face parallel to the first face of the first arm when said first arm extends in said second position of the first arm, while the second abutment portion of the blocking means has an abutment face parallel to the first face of the second arm when said second arm extends in said second position of the second arm, whereby said process comprises at least the following steps:

the drill pipe with the system having the first arm and the second arm extending in their first position is placed in the well bore, the support is moved downwardly with respect to the body so that the first arm and the second arm are pivotable around an axis of rotation perpendicular to the longitudinal direction of the body, the blocking means is moved upwardly so as to pivot the first arm and the second arm in said second position of said first and second arms and so as to block said first arm and second arm at least in said second position, and the drill pipe with the system with the first arm and the second arm in said second position is driven into rotation in the well bore for increasing the diameter of at least a portion of said well bore.

26. The process of claim 25, in which a system for which the second face of the first arm of the system comprises a flat portion which is parallel to and contacts a third inclined face of the chamber when the first arm extends in said first position of the first arm, and for which the second face of the second arm comprises a flat portion which is parallel to and contacts a fourth inclined face of the chamber when the second arm extends in said first position of the second arm is driven into rotation in the well bore for increasing the diameter of at least a portion of said well bore.

27. The process of claim 25, in which the system used is a system in which the first arm of the system has a protuberance with a lateral end face corresponding to a portion of the lateral face of a cylinder centered with respect to the axis of pivotment of the arm with respect to the support element, and in which the second arm has a protuberance with a lateral end face corresponding to a portion of the lateral face of a cylinder centered with respect to the axis of pivotment of the second arm with respect to the support element, the support element having a first recess in which the first protuberance extends and a second recess in which the second protuberance extends, said first recess having a face contacting at least partly the lateral end face of the protuberance of the first arm, while said second recess has a face contacting at least partly the lateral end face of the protuberance of the second arm.

28. The process of claim 25, in which the system used is a system in which the support element of the system is provided with a central longitudinal passage in which a rod extends, said rod bearing the blocking means.

29. The process of claim 25, in which the system used is a system further comprising a means for controlling the relative longitudinal movement of the support element with respect to the body and the relative longitudinal movement of the blocking means with respect to the body.

30. The process of claim 29, in which the controlling means used comprises an indexer with various positions selected from the group consisting of working position, closing position, measuring position and adapting position.

31. The process of claim 25, in which the system used is a system further comprising a stabilizing means.

32. A drilling process for increasing the diameter of at least a portion of a well bore, including the step of increasing the diameter of at said at least a portion of the well bore by drilling, wherein the drilling of the portion of the well bore which has to be increased is carried out by driving into rotation in the well bore a drill pipe provided with a system, said system comprising:

a) a longitudinal substantially cylindrical body extending in a longitudinal direction, said body being provided with means adapted for attaching said body to the drill pipe and haying at least one chamber and two openings, said body of the system being provided with:

a first means pivotably mounted with respect to the body around an axis parallel to the axis of pivotment of the first arm, said first means having a flat surface adapted to contact a flat portion of the second face of the first arm at least when the first arm extends partly outside of the opening between its first position and its second position, and a second means pivotably mounted with respect to the body around an axis parallel to the axis of pivotment of the second arm, said second means having a flat surface adapted to contact a flat portion of the second face of the second arm at least when the second arm extends partly outside of the opening between its first position and its second positions b) a support element movably mounted with respect to the body in the longitudinal direction of the body, said support comprising a first shaft and a second shaft parallel to each other and perpendicular to the longitudinal direction of the body, said element being located in the chamber of the body;

c) first and second arms provided with cutting means, the first arm being pivotably mounted on the support element around an axis of pivotment perpendicular to the longitudinal direction of the body, while the second arm is pivotably mounted on the support element around an axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body; and d) a blocking means provided with at least a first abutment portion and a second abutment portion, said means being movably mounted with respect to the body in the longitudinal direction of the body;

in which each of said first and second arms when located in the chamber has at least one first face directed towards the longitudinal axis of the body and at least one second face directed opposite to the longitudinal axis of the body, in which the chamber of the body has a first face inclined with respect to the longitudinal direction of the body, said first face of the chamber acting as an abutment for the second face of the first arm when said first arm extends in said second position, and a second face inclined with respect to the longitudinal direction of the body, said second face of the chamber acting as an abutment for the second face of the second arm when said second arm extends in said second position, and in which the first abutment portion of the blocking means has an abutment face parallel to the first face of the first arm when said first arm extends in said second position, while the second abutment portion of the blocking means has an abutment face parallel to the first face of the second arm when said second arm extends in said second position, whereby said process comprises at least the following steps:

the drill pipe with the system having the first arm and the second arm extending in their first position is placed in the well bore.

the support is moved downwardly with respect to the body so that the first arm and the second arm are pivotable around an axis of rotation perpendicular to the longitudinal direction of the body, the blocking means is moved upwardly so as to pivot the first arm and the second arm in said second position of said first and second arms and so as to block said first arm and second arm at least in said second position, and the drill pipe with the system with the first arm and the second arm in said second position is driven into rotation in the well bore for increasing the diameter of at least a portion of said well bore.

33. A drilling process for increasing the diameter of at least a portion of a well bore, including the step of increasing the diameter of said at least a portion of the well bore by drilling, wherein the drilling of the portion of the well bore which has to be increased is carried out by driving into rotation in the well bore a drill pipe provided with a system, said system comprising:

a) a longitudinal substantially cylindrical body extending in a longitudinal direction, said body being provided with means adapted for attaching said body to the drill pipe and haying at least one chamber and two openings, b) a support element movably mounted with respect to the body in the longitudinal direction of the body, said support comprising a first shaft and a second shaft parallel to each other and perpendicular to the longitudinal direction of the body, said element being located in the chamber of the body;

c) first and second arms provided with cutting means, the first arm being pivotably mounted on the support element around an axis of pivotment perpendicular to the longitudinal direction of the body, while the second arm is pivotably mounted on the support element around an axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body; and d) a blocking means provided with at least a first abutment portion and a second abutment portion, said means being movably mounted with respect to the body in the longitudinal direction of the body; whereby the blocking means of the system is provided with:

a first means pivotably mounted with respect to the blocking means around an axis parallel to the axis of pivotment of the first arm, said first means having a flat surface adapted to contact a flat portion of the first face of the first arm at least when the first arm is blocked partly outside of the opening between its first position and its second position, and a second means pivotably mounted with respect to the blocking means around an axis parallel to the axis of pivotment of the second arm, said second means having a flat surface adapted to contact a flat portion of the first face of the second arm at least when the second arm is blocked partly outside of the opening between its first position and its second position, whereby said process comprises at least the following steps:

the drill pipe with the system having the first arm and the second arm extending in their first position is placed in the well bore, the support is moved downwardly with respect to the body so that the first arm and the second arm are pivotable around an axis of rotation perpendicular to the longitudinal direction of the body, the blocking means is moved upwardly so as to pivot the first arm and the second arm in said position of said first and second arms and so as to block said first arm and second arm at least in said second position, and the drill pipe with the system with the first arm and the second arm in said second position is driven into rotation in the well bore for increasing the diameter of at least a portion of said well bore.

34. A drilling process for increasing the diameter of at least a portion of a well bore, including the step of increasing the diameter of said at least a portion of the well bore by drilling, wherein the drilling of the portion of the well bore which has to be increased is carried out by driving into rotation in the well bore a drill pipe provided with a system, said system comprising:

a) a longitudinal substantially cylindrical body extending in a longitudinal direction, said body being provided with means adapted for attaching said body to the drill pipe and having at least one chamber and two openings, whereby the body is provided with:

a first means pivotably mounted with respect to the body around an axis parallel to the axis of pivotment of the first arm, said first means having a flat surface adapted to contact a flat portion of the second face of the first arm at least when the first arm extends partly outside of the opening between its first position and its second position, said flat surface forming an extension of the first face when the second face of the first arm abuts the first inclined face of the body, and a second means pivotably mounted with respect to the body around an axis parallel to the axis of pivotment of the second arm, said second means having a flat surface adapted to contact a flat portion of the second face of the second arm at least when the second arm extends partly outside of the opening between its first position and its second position, said flat surface forming an extension of the second inclined face of the body when the second face of the second arm abuts the second inclined face of the body.

b) a support element movably mounted with respect to the body in the longitudinal direction of the body, said support comprising a first shaft and a second shaft parallel to each other and perpendicular to the longitudinal direction of the body, said element being located in the chamber of the body;

c) first and second arms provided with cutting means, the first arm being pivotably mounted on the support element around an axis of pivotment perpendicular to the longitudinal direction of the body, while the second arm is pivotably mounted on the support element around an axis of pivotment parallel to the axis of pivotment of the first arm, each arm pivoting with respect to the support element between a first position in which the arm extends in the chamber and a second position in which at least a portion of the cutting means extends outside the chamber after passing through an opening of the body; and d) a blocking means provided with at least a first abutment portion and a second abutment portion, said means being movably mounted with respect to the body in the longitudinal direction of the body;

whereby said process comprises at least the following steps:

the drill pipe with the system having the first arm and the second arm extending in their first position is placed in the well bore.

the support is moved downwardly with respect to the body so that the first arm and the second arm are pivotable around an axis of rotation perpendicular to the longitudinal direction of the body, the blocking means is moved upwardly so as to pivot the first arm and the second arm in said second position of said first and second arms and so as to block said first arm and second arm at least in said second position, and the drill pipe with the system with the first arm and the second arm in said second position is driven into rotation in the well bore for increasing the diameter of at least a portion of said well bore.

35. The process of claim 34, in which the system used is a system in which the first means pivotally mounted on the body of the system is located between the first inclined face of the body and a third inclined face of the body, and in which the second means pivotally mounted on the body is located between the second inclined face of the body and a fourth inclined face of the body.

36. The process of claim 34, in which the system used is a system in which the first means pivotally mounted on the body of the system is located between the first inclined face of the body and a third inclined face of the body, while the second means pivotally mounted on the body is located between the second inclined face of the body and a fourth inclined face of the body, the inclination of the first and second inclined faces with respect to the longitudinal axis of the body being comprised between 60° and 90°, and in which the inclination of the third and fourth inclined faces with respect to the longitudinal axis of the body is comprised between 15° and 50°.

* * * * *